US005165579A

United States Patent [19]

Lund

[11] Patent Number: 5,165,579

[45] Date of Patent: Nov. 24, 1992

[54] DETACHABLE LID FOR A BEVERAGE CAN WITH A CAN OPENING TOOL

[75] Inventor: Bihari Lund, Edison, N.J.

[73] Assignee: Glaze Inc., Edison, N.J.

[21] Appl. No.: 764,748

[22] Filed: Sep. 24, 1991

[51] Int. Cl.[5] ..... B67D 1/16

[52] U.S. Cl. ..... 222/192; 222/191; 222/543; 222/570; 220/258; 220/375; 220/717; 81/3.09; 81/3.15

[58] Field of Search ..... 222/191, 192, 543, 545, 222/570; 215/228, 306; 220/90.2, 90.4, 375, 717, 258; 81/3.55, 3.09, 3.15; 7/151; 291/27.1, 33

[56] References Cited

U.S. PATENT DOCUMENTS

| | | | |
|---|---|---|---|
| 2,046,804 | 7/1936 | Youngblood | 81/3.09 |
| 3,014,621 | 12/1961 | Povitz | 222/191 |
| 3,117,701 | 1/1964 | Stull | 222/543 |
| 4,579,257 | 4/1986 | Brandlein | 222/191 X |
| 4,911,038 | 3/1990 | Ferrin | 81/3.09 |
| 4,938,379 | 7/1990 | Kellner | 220/90.4 |
| 4,961,510 | 10/1990 | Dvoracek | 220/90.4 |
| 5,044,512 | 9/1991 | Giancaspro et al. | 215/306 X |

*Primary Examiner*—Gregory L. Husen

*Attorney, Agent, or Firm*—Jordan and Hamburg

[57] ABSTRACT

A detachable lid for a beverage can is adapted to be snap fit over the lid of an opened can. The lid has a spout adapted to be fit in the users mouth, a closure for the spout, a resilient strap for holding the closure to the lid, and a pry tab to enable the user to pry up the opening tab of a "snap-open" can.

16 Claims, 3 Drawing Sheets

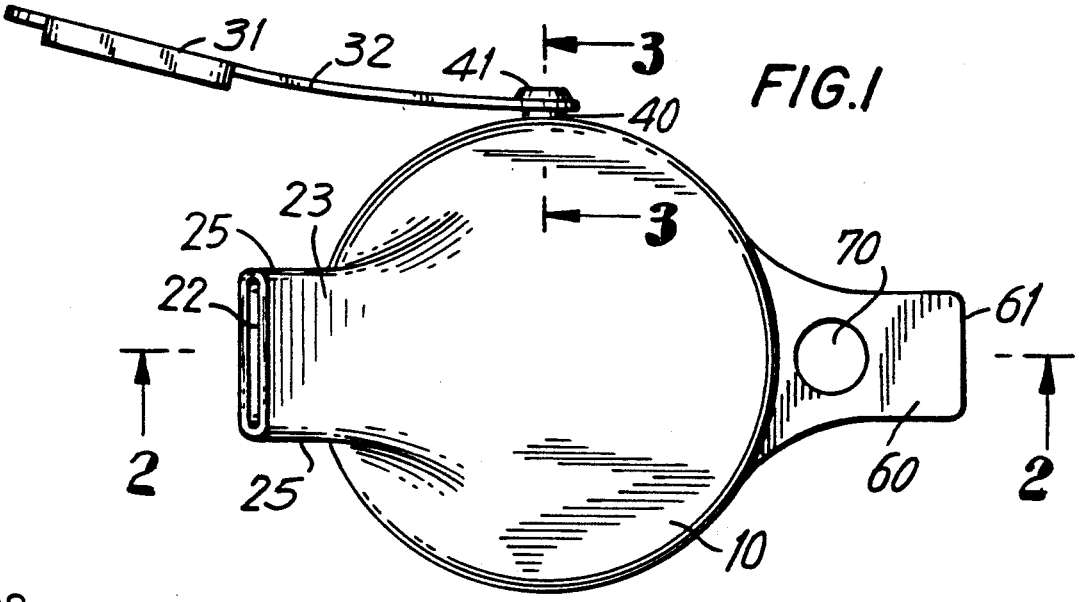
FIG.1
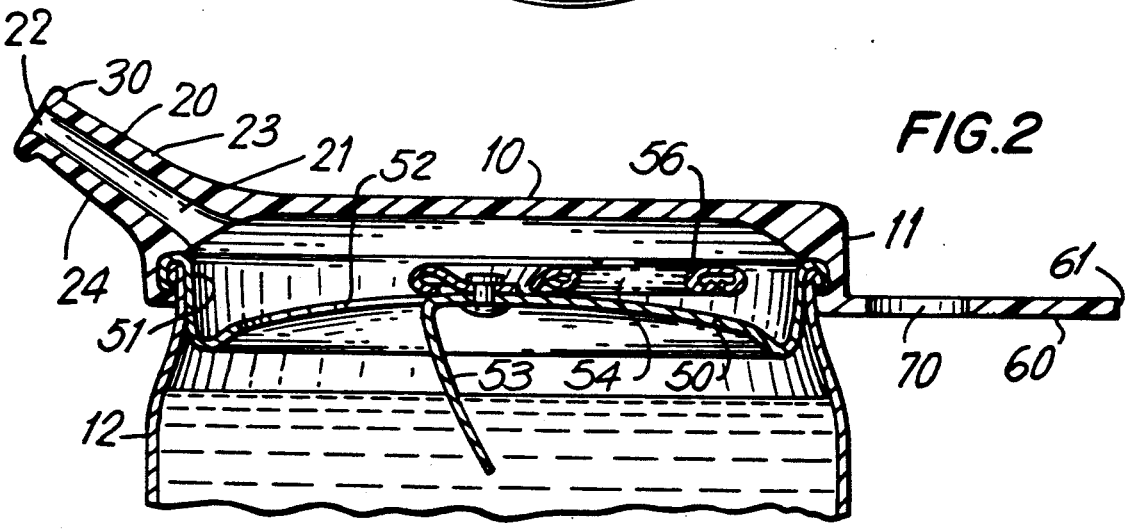
FIG.2
FIG.3
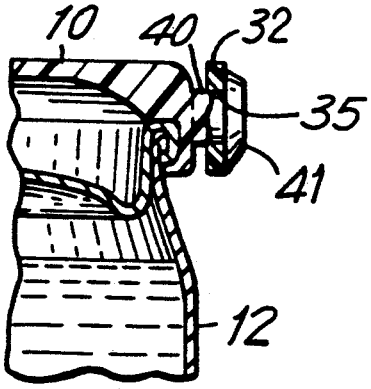
FIG.4
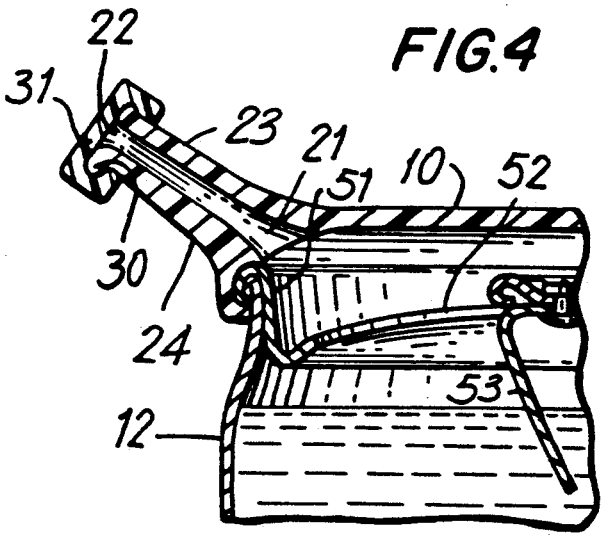

DETACHABLE LID FOR A BEVERAGE CAN WITH A CAN OPENING TOOL

FIELD OF THE INVENTION

This invention relates to closures for beverage cans, and is of especial application for use with closures for cans of the type having an upper panel to which an opening tab is affixed for snapping a weakened can portion open, to thereby provide a dispensing opening.

BACKGROUND OF THE INVENTION

It is well known to provide a detachable lid for a can or the like, wherein a detachable lid is adapted to be snapped over the top of the can, and the cover has a spout or other opening for enabling the outward flow of liquids from the can. Such covers are disclosed, for example, in U.S. Pat. Nos. 2,550,568; 2,617,563; 3,154,226; 4,014,465; 4,090,660; 4,403,709; 4,460,103; 4,478,346; 4,561,557; 4,796,774; 4,703,873; 4,869,389; 4,883,192 and 4,899,902. It is also known, in such devices, to provide a snap cap for the spout, to enable closing it to prevent the outward flow of liquids, as seen, for example, in U.S. Pat. Nos. 4,090,660; 4,561,557; 4,703,873; 4,478,346 and 4,796,774.

SUMMARY OF THE INVENTION

The present invention is directed to the provision of a detachable lid of the above type that provides features that are especially advantageous for use with beverage cans of the "snap-open" type, such features not being provided in the above noted prior art.

Briefly stated, the invention provides a detachable lid for engagement with the upper end of a beverage can of the "snap-open" type, having an opening tab adapted to be pulled up to effect the opening of a dispensing opening. The lid includes a spout for pouring the contents of the can, as well as a resilient strap that snaps over the spout to close it. A pry tab is provided on the lid to enable the user to pry up the opening tab on the can. A hole is provided in the pry tab for storing the detachable lid on a key ring or hook. The pry tab is integrally formed with the detachable lid and is positioned 180° from the spout.

BRIEF DESCRIPTION OF THE DRAWING

In order that the invention may be more clearly understood, it will now be disclosed in greater detail with reference to the accompanying drawings, wherein:

FIG. 1 is a top view of one embodiment of a detachable lid in accordance with the invention;

FIG. 2 is a cross sectional view of the lid of FIG. 1, taken along the lines 2—2, and including a portion of a can upon which the lid is mounted;

FIG. 3 is an enlarged cross-sectional view of a portion of the lid, taken along the lines 3—3 of FIG. 1;

FIG. 4 is an enlarged cross sectional view of the spout, illustrating the closure thereon;

DETAILED DISCLOSURE OF THE INVENTION

Figure 5:
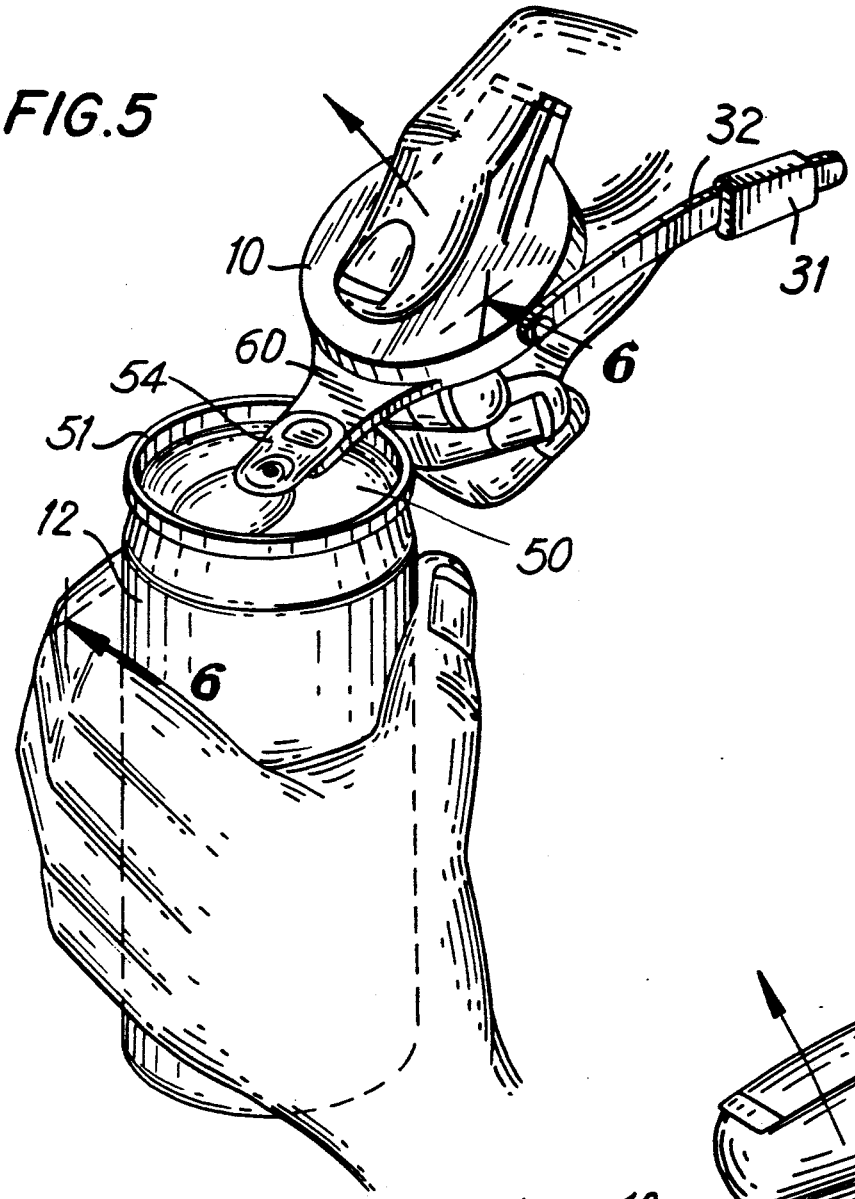
FIG. 5 is a perspective view showing the opening of a beverage can with the detachable lid of the invention.

Referring now to the drawings, and more in particular to FIGS. 1 and 2, the detachable lid of the present invention includes a cover panel 10 having a downwardly extending peripheral flange or rim 11. The cover panel 10 has the peripheral shape of the top of beverage can 12 upon which is to be fit, and transverse dimensions to enable the flange 11 to be snapped over the top of the can for sealingly holding the cover panel 10 to the can, as illustrated for example in FIG. 4. While the cover panel will hence usually be circular, as illustrated, it is evident that it may have other shapes to enable it be fit onto cans or the like of such other shapes. The cover panel is also preferably of a plastic material having sufficient resilience to enable it to be snapped over the top of the can, and sufficient rigidity to enable it to be firmly sealingly held in use.

As seen in FIGS. 1, 2 and 4, a spout 20 is provided extending upwardly from the cover panel. (It will of course be understood that reference to upward and downward directions herein is only for convenience in describing the illustrations, and is not intended to limit the invention.) The spout 20 has a central hole 21 extending from the underside of the cover panel 10, to an exit 22 above the cover panel. The top surface 23 and under surface 24 of the spout are generally flat and parallel, with the edges 25 thereof being slightly rounded. Alternatively, the spout may have an elliptical or oblong cross section. The spout extends outwardly from the periphery of the cover panel at an acute angle to the cover panel. (Although the top of the cover panel 10 may be flat, it is not necessarily so, and hence it will be understood that reference to an "angle to the cover panel" as used herein denotes an angle referenced to the plane defined by the top edge of a can or the like onto which the detachable lid is adapted to be fit).

By extending the spout upwardly and outwardly of the cover panel and at an acute angle thereto, as above discussed, the outer end of the spout is positioned at a location that simplifies its use. Thus, with this position of the end of the spout, the spout lies primarily above and laterally of a can upon which the lid of the invention is mounted. As a result, its insertion into the mouth of a user involves a minimum of physical interference between the user and the can and/or lid. In addition, the angle through which the can must be tilted in order to dispense a beverage therefrom is also minimized. For this purpose, it has been found that the angle between the spout and the cover panel should be between 30° and 60°.

The spout is shaped to facilitate its positioning in the mouth of a user, and hence it is elongated in the horizontal direction, with the central hole 21 therein being generally slot-shaped. This shape enable the provision of a hole in the spout of greater cross section, for easier drawing of the liquid from the can into the users mouth, while still enabling the spout to fit comfortably in the users mouth. Since both the top and the bottom and edge surface of the spout are enclosed, and the cover panel is not otherwise apertured, there is no danger of escape of liquid from the can except into the user's mouth, when the can is tilted to enable the user to drink.

As illustrated in FIGS. 2 and 4, a ridge 30 may be provided extending around the outer end of the spout. This ridge enables a closure 31 to be snap fit to cover the exit 22 of the spout. In order to enable the closure 31 to be always readily available for use; it is held to the cover panel by a resilient strap 32. As illustrated in FIG. 1, the strap 32 may constitute an element that has been molded of plastic to be integral with the closure 31.

In order to hold the strap 32 to the cover panel, as illustrated in FIG. 1 and 3, a projection 40, which may have a circular cross section, is provided extending laterally from the cover panel, for example from the rim 11. The end of the strap 32 away from the closure 31 has a hole 35 that is fit on the projection 40, the fit being sufficiently loose that the strap is generally rotatable with respect to the projection. The strap 32 is held to the projection 40 by providing an enlarged end 41 on the projection. The strap is of course of sufficient length that it can be readily moved to a position to close the exit 22 of the spout.

Referring again to FIG. 2, the beverage can 12 is of the "snap-open" type, having a top 50 affixed to the rim 51 of the can, for example by rolling. The 50 has a weakened portion defining a dispensing opening 52, so that the region 53 defined by the weakened portion can be snapped downwardly upon the application of a force thereto, thereby opening the can. An opening tab 54 is affixed to the top 50 and positioned so that, upon raising the free end 56 of the opening tab, a projection of the tab forces the region 53 downwardly, to effect the opening of the dispensing opening. When attempting to open a beverage can of this type, it is frequently difficult to raise the opening tab, since the tab may be positioned abutting the top of the can, thereby rendering it difficult for a user to apply an upward force to the underside of the tab. In addition, raising of the tab is rendered more difficult since it must be raised with sufficient force to cause the metal of the top of the can to shear at its weakened portion.

In order to overcome this problem, the detachable lid of the present invention is provided with a pry tab 60 projecting from the cover panel 10. The pry tab 60 preferably depends from the rim 11 of the cover panel, in a direction parallel to the cover panel (i.e. parallel to the plane of the top of a can onto which the lid is adapted to be mounted). The pry tab is generally flat, and the end 61 thereof is shaped to enable it to be forced under the opening tab of the can. For example, the end 61 may be straight, extending in a direction parallel to the tangent to the cover panel at the point at which the center of the pry tab is affixed.

As illustrated in FIG. 1, the pry tab is located at a position on the cover panel that is displaced about 180° from the spout, and 90° from the projection 40 to which the strap 32 is attached.

Figure 6:
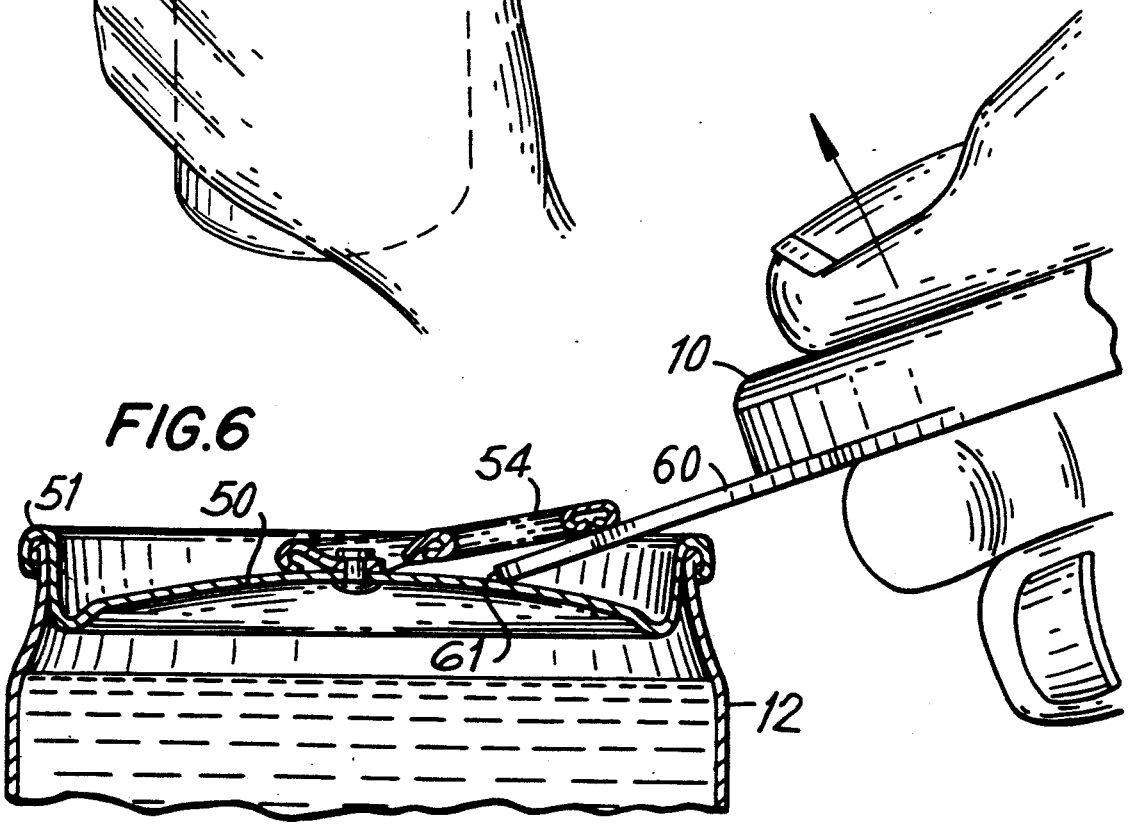
FIG. 6 is a partial cross sectional view of FIG. 5, taken along the lines 6—6.

The use of the pry tab 60, in the prying up of the opening tab 54 of a can, is illustrated in FIGS. 5 and 6. The user grasps the cover panel 10, with the pry tab 60 extending outwardly, and forces the end 61 of the pry tab under the opening tab 54. Upon the application of upward pressure to the detachable lid, the pry tab 60 forces the opening tab upwardly, to effect the opening of the can in a simple manner with a minimum of effort.

As further illustrated in FIGS. 1 and 2, a hole 70 is provided in the pry tab. This hole permits the detachable lid of the invention to be readily stored for use, for example on a key chain or on a suitable hook.

In accordance with the invention, it is preferred that the cover panel 10, the rim 11, the spout 20 and the pry tab be molded of plastic material as a single unitary element, and that, similarly, the closure 31 and strap 32 be molded of plastic material as another single unitary element.

Figure 7:
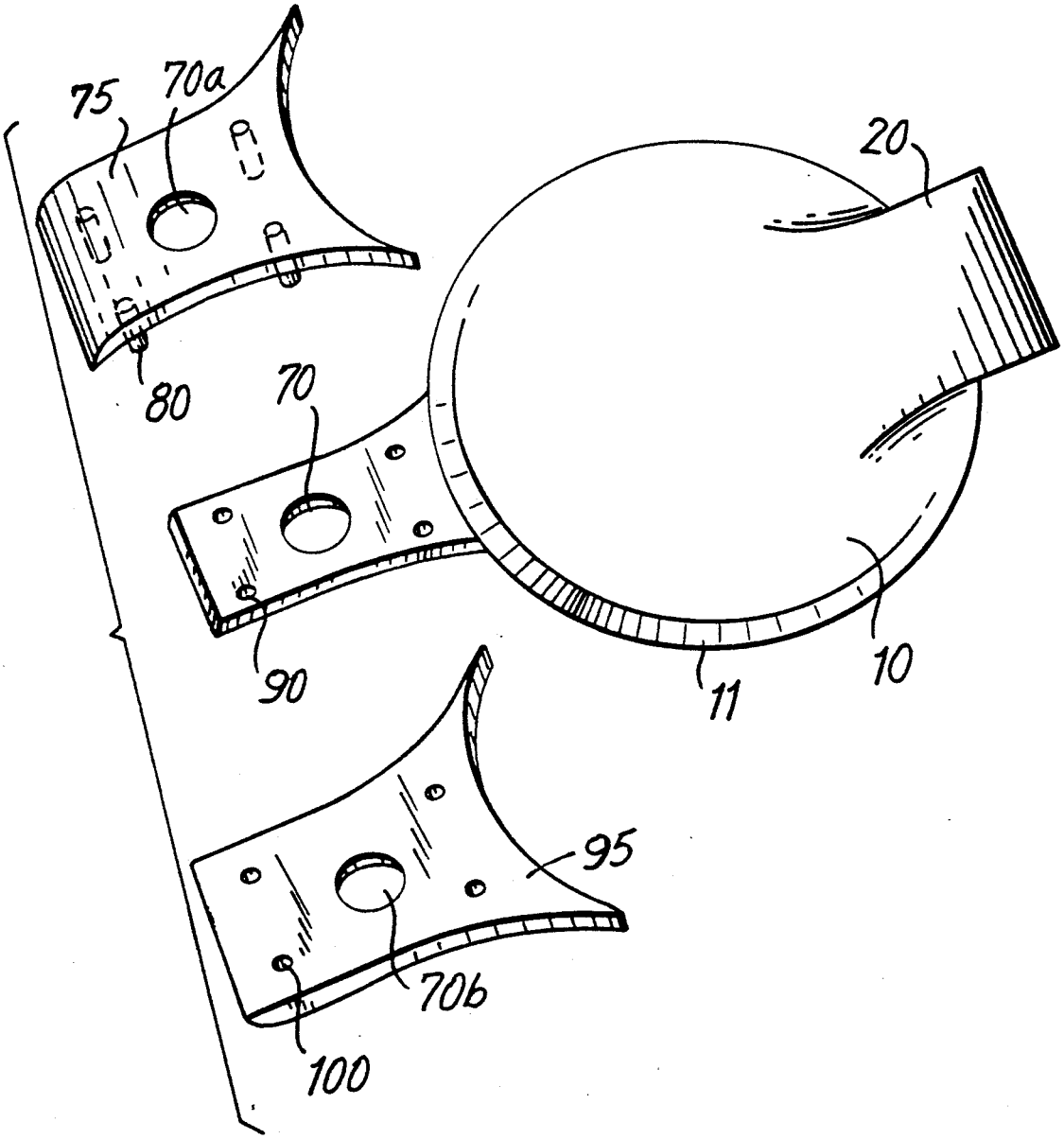
FIG. 7 is an exploded perspective view of another embodiment of detachable lid in accordance with the invention.

Preferably, the cover panel 10, the rim 11, the spout 20 and the pry tab will be molded of a plastic, such as a polyurethane, which is substantially pliable to facilitate fitting of the detachable lid onto and removal of the lid from a can or the like. However, the pry tab need not be pliable for this purpose because pliability of the pry tab per se does not contribute to ease of fitting and removal of the lid. On the contrary, pliability of the pry tab makes the pry tab less effective for its intended prying function. The embodiment of FIG. 7 is directed to solving this problem. The pry tab 60', having the hole 70 therein, is reinforced by being sandwiched between upper and lower pry tab reinforcers 75 and 95, which are made of substantially rigid, i.e., substantially non-pliable, plastic, such as an acrylonitrile-butadiene-styrene ("ABS") resin. The tab reinforcers 75 and 95 are provided with respective holes **70*a* and 70*b* which match and register with the hole 70. A set of four "teeth", in the form of pins 80 integrally molded on the lower face of the reinforcer 75 and extending downwardly substantially vertically therefrom, pass through a set of four holes 90 in the tab 60' and are received snugly in a set of four holes 100 in the reinforcer 95 thereby binding together as an assembly the tab 60' and the reinforcers 75 and 95**. The pry tab thereby acquires substantially the rigidity of the ABS instead of the pliability of polyurethane.

While the invention has been disclosed and described with reference to only two embodiments, it will be apparent that variations and modification may be made therein, and it is therefore intended in the following claims to cover each such variation and modification as falls within the true spirit and scope of the invention.

What is claimed is:

1. A detachable lid for a snap open beverage can of the type having an upper rim defining a can top, a weakened portion defining a dispensing opening, and an opening tab mounted to the lid for snapping open said weakened portion, said detachable lid comprising a cover panel having an outer rim for snapping over said upper rim of said can, a spout extending from said cover panel, a closure for detachably closing said spout, resilient means for holding said closure to said cover panel, and a pry tab extending from said cover panel, said pry tab being shaped to be fit under said opening tab to pry the opening tab away from said can top, said cover panel, said rim of said cover panel, said spout and said pry tab being molded of a pliable plastic as a single unitary element, and said detachable lid further comprising a pair of pry tab reinforcers molded of a rigid, non-pliable plastic, said pry tab being sandwiched between said pry tab reinforcers as a reinforced pry tab assembly.

2. The detachable lid of claim 1 wherein said reinforced pry tab assembly has a carrying hole therein to permit said detachable lid to be held to a key ring or hook.

3. The detachable lid of claim 1 wherein said cover panel has a projection extending therefrom, said resilient means comprising a resilient strap having a hole in one end that is movably fit over said projection, said projection having an enlarged end to inhibit removal of said strap therefrom.

4. The detachable lid of claim 1 wherein one of said pry tab reinforcers includes a face carrying a plurality of upstanding pins, said pry tab has a plurality of throughholes for passage of said pins therethrough and the other of said pry tab reinforcers has a plurality of holes therein for receiving said pins with a snug fit.

5. The detachable lid of claim 1 wherein said spout projects upwardly and outwardly from said cover panel at an acute angle to the cover panel, and has enclosed top, bottom and edge sides.

6. The detachable lid of claim 5 wherein said spout is laterally elongated, and has a generally slot shaped hole extending lengthwise therethrough.

7. A detachable lid for a beverage can, comprising a cover panel, said cover panel having a peripheral rim extending from one side of the periphery of a central portion, for fitting said lid on a can, a spout extending from the side of said cover panel opposite said one side, said spout having a hole extending longitudinally through said spout and constituting the only aperture in said cover panel, a closure for said spout, resilient strap means for holding said closure to said cover panel, and a pry tab affixed to said cover panel, said cover panel, said rim of said cover panel, said spout and said pry tab being molded of a pliable plastic as a single unitary element, and said detachable lid further comprising a pair of pry tab reinforcers molded of a rigid, non-pliable plastic, said pry tab being sandwiched between said pry tab reinforcers as a reinforced pry tab assembly.

8. The detachable lid of claim 7 wherein said reinforced pry tab assembly has a storing hole extending therethrough.

9. The detachable lid of claim 7 wherein said pry tab is flat and has a pry edge away from said cover panel that is straight.

10. The detachable lid of claim 7 wherein said pry tab extends substantially parallel to the plane of the top edge of a can on which said lid is mounted.

11. The detachable lid of claim 7 wherein one of said pry tab reinforcers includes a face carrying a plurality of upstanding pins, said pry tab has a plurality of throughholes for passage of said pins therethrough and the other of said pry tab reinforcers has a plurality of holes therein for receiving said pins with a snug fit.

12. The detachable lid of claim 7 wherein said spout extends outwardly of said cover panel at an acute angle to said cover panel, whereby said spout has an end that is spaced outwardly of the sides of a can upon which said lid is mounted.

13. The detachable lid of claim 12 wherein said spout has fully enclosed upper, lower and edge surfaces.

14. The detachable lid of claim 7 further comprising a projection extending from said cover panel, said resilient means comprising a resilient strap having a hole on one end thereof for receiving said projection, and means for holding said strap on said projection, whereby said strap is rotatable with respect to said projection.

15. The detachable lid of claim 14 wherein said spout is mounted adjacent the periphery of said cover panel at a first location, and said pry tab extends from said cover panel adjacent the periphery at a second location opposite said first location.

16. The detachable lid of claim 15 wherein said strap is held to the periphery of said cover panel at a third location substantially equidistant between said first and second locations.

* * * * *